US005588824A

United States Patent [19]

McMillan

[11] Patent Number: 5,588,824

[45] Date of Patent: Dec. 31, 1996

[54] INJECTION NOZZLE

[75] Inventor: Robin T. D. McMillan, Untersiggenthal, Switzerland

[73] Assignee: ABB Management AG, Baden, Switzerland

[21] Appl. No.: 552,121

[22] Filed: Nov. 2, 1995

[30] Foreign Application Priority Data

Dec. 19, 1994 [DE] Germany ..... 44 45 279.9

[51] Int. Cl.[6] ..... F23Q 9/08

[52] U.S. Cl. ..... 431/285; 431/174; 431/178; 431/278; 431/351; 239/403; 239/568

[58] Field of Search ..... 431/278, 285, 431/351, 175, 177, 178, 174; 239/403, 568

[56] References Cited

U.S. PATENT DOCUMENTS 2,464,791 3/1949 Bonvillian et al. ..... 431/175
4,269,583 5/1981 Straitz ..... 431/285
5,169,302 12/1992 Keller ..... 431/351

FOREIGN PATENT DOCUMENTS

0433790A1 6/1991 European Pat. Off. .
1240706 5/1967 Germany .
1751929 9/1970 Germany .
2026883 12/1971 Germany .

*Primary Examiner*—Carroll B. Dority
*Attorney, Agent, or Firm*—Burns, Doane, Swecker & Mathis

[57] ABSTRACT

In an injection nozzle for introducing fuels into compressed gaseous media, for use in premixing burners for example, the injection nozzle (1) consists primarily of a fuel conduit (2) and a passage branching off from the fuel conduit. The fuel conduit (2) extends lengthwise essentially at right angles to the direction of introduction of the fuel and the passage extends parallel to the direction of introduction of the fuel. The fuel is fed via slots (6) in the fuel conduit and by means of the passage to an atomization edge (5). The inside of the passage is made up of distribution panels (3) between which distribution pins (4) are arranged.

7 Claims, 2 Drawing Sheets

INJECTION NOZZLE

BACKGROUND OF THE INVENTION

1. Field of the Invention

The invention relates to an injection nozzle for introducing fuels into compressed gaseous media, for use in premixing burners for example, the injection nozzle consisting primarily of a fuel conduit and a passage branching off from the fuel conduit, the fuel conduit extending lengthwise essentially at right angles to the direction of introduction of the fuel and the passage extending parallel to the direction of introduction of the fuel.

2. Discussion of Background

Such injection nozzles are known from EP-A1-0 433 790. They are there employed in premixing burners which are built up conically as so-called double-cone burners from a plurality of shells. When a medium calorific value gas is employed as the fuel, the injection nozzles make premature ignition of the mixture impossible and permit stabilization of the mixing procedure. Liquid fuel is injected into the combustion space by means of a nozzle arranged at the apex of the premixing burner. The atomization performance of these nozzles is, however, generally inadequate. In addition, good mixing of the combustion air and fuel before ignition cannot usually be achieved by this means because the atomized fuel does not come into contact with the whole of the combustion air. When liquid fuels are employed, this leads to relatively high exhaust gas emissions, in particular to high emission of oxides of nitrogen. In order to reduce the emission of oxides of nitrogen, the injection of demineralized water into the combustion space is necessary.

SUMMARY OF THE INVENTION

Accordingly, one object of the invention is to provide a novel possibility, in an injection nozzle of the type mentioned at the beginning, in order to improve the mixing of liquid fuel with the combustion air prior to ignition and, by this means, to reduce the exhaust gas emissions.

In accordance with the invention, this is achieved by the fuel being fed via slots in the fuel conduit and by means of the passage to an atomization edge, the inside of the passage being made up of distribution panels between which distribution pins are arranged.

The advantages of the invention may be seen, inter alia, in that the injection nozzle is of simple and robust construction. It can be operated with a low fuel pressure because the momentum of the air flow is used for atomization.

When the injection nozzle is used in a premixing burner, for example in a double-cone burner, the fuel is distributed along the air inlet slots. This provides uniform and good mixing with the combustion air before ignition. The result is low pollutant emission.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein an embodiment example of the invention is represented diagrammatically using a premixing burner of the double-cone type and wherein.

DESCRIPTION OF THE PREFERRED EMBODIMENTS

Figure 1:
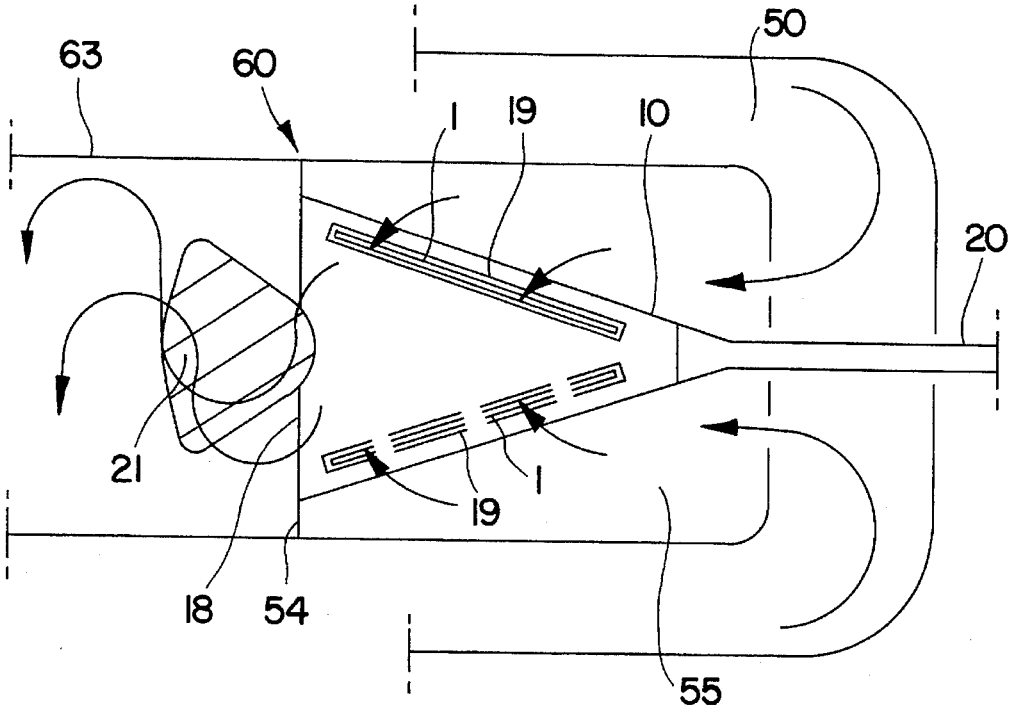
FIG. 1 shows a partial longitudinal section of a combustion chamber.

Referring now to the drawings, wherein like reference numerals designate identical or corresponding parts throughout the several views, wherein the flow direction of the working media is indicated by arrows and wherein only the elements essential to understanding the invention are shown (not shown, for example, is the arrangement of the burner relative to and in the combustion chamber, the fuel preparation, the control devices and the like), FIG. 1 shows an enclosed plenum which is designated by 50 and which, as a rule, accepts the combustion air delivered by a compressor (not shown) and leads it to a combustion chamber 60. The combustion chamber can be either an individual combustion chamber or an annular combustion chamber.

A dome 55 is placed at the top end of the combustion chamber, whose combustion space is surrounded by a combustion chamber wall 63 and bounded by a front panel 54. A burner 10 is arranged in this dome in such a way that the burner outlet 18 is at least approximately flush with the front panel 54. The combustion air flows out of the plenum 50 via the dome wall, which is perforated at its outer end, into the inner part of the dome and is admitted to the burner. The fuel is supplied to the burner via a fuel lance 20 which penetrates the dome wall and the plenum wall.

Figure 2:
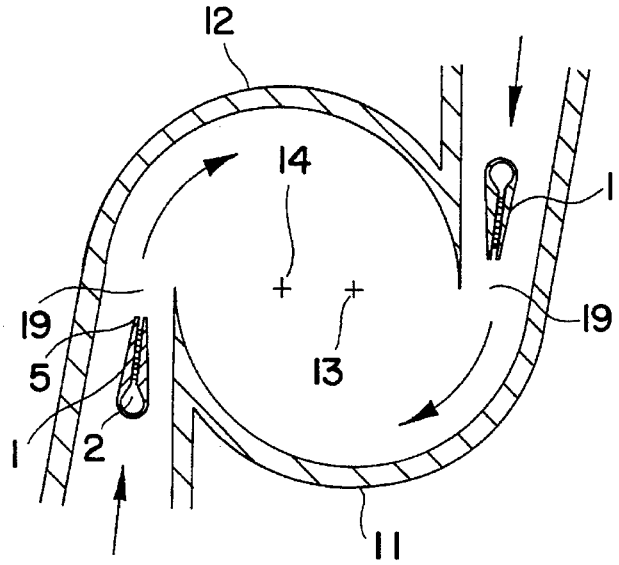
FIG. 2 shows a cross section through a premixing burner of the double-cone type in the region of its outlet.

The diagrammatically represented premixing burner 10 is a so-called double-cone burner such as is already known from EP-A1-0 433 790, quoted at the beginning. As may be seen from FIG. 2, it consists essentially of two hollow, conical partial bodies 11 and 12 which are interleaved in the flow direction. The respective center lines 13 and 14 of the two partial bodies are offset relative to one another. In their longitudinal extent, the adjacent walls of the two partial bodies form tangential slots 19 for the combustion air, which reaches the inside of the burner in this way.

In the case given as an example, the burner is operated with liquid fuel. For this purpose, injection nozzles 1 extending along the tangential slots 19 are arranged in the region of these slots. The injection nozzle extends substantially over the whole of the length of the tangential slot 19 (FIG. 1). The outlet plane of the fuel from the injection nozzle 1 is usually arranged in the region where the highest combustion air velocities are present, in the center of the tangential slot 19 in the embodiment example shown. In addition, the injection nozzles 1 have an aerodynamic, droplet-shaped design on the outside in order to disturb the flow of the combustion air as little as possible.

Figure 3:
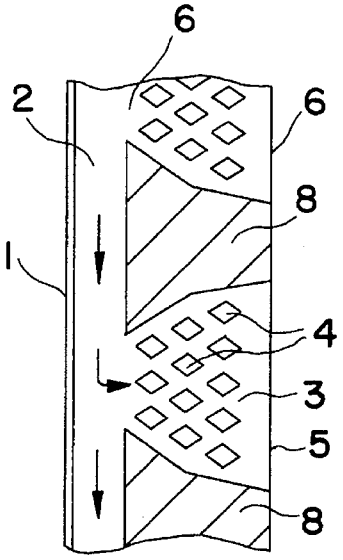
FIG. 3 shows a partial longitudinal section through an injection nozzle.
Figure 4:
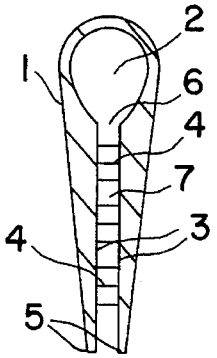
FIG. 4 shows a cross section through an injection nozzle.

As shown in FIGS. 3 and 4, the injection nozzle 1 consists of a fuel conduit 2 which has a slot 6 over its length. A passage 7, which leads to an atomization edge 5, branches off from the slot 6. The liquid fuel is led from the fuel lance 20 to the fuel conduit 2 of the injection nozzle via supply conduits, which are not shown. The fuel is fed through the fuel conduit 2 via the slots 6 to distribution panels 3 which form the passage 7. The arrangement and size of these distribution panels 3 can be set by means of intermediate pieces 8. This setting takes place by taking into account the flow of the combustion air through the tangential slots 19 and has to be matched to the particular burner 10. In the extreme case, the distribution panel 3 can extend over the complete length of the injection nozzle 1. Rhomboid distribution pins 4 are arranged on the distribution panel. By means of the distribution pins 4, the fuel is uniformly distributed upstream of the atomization edge 5. The thickness of the fuel film generated in this way is determined by the gap width t of the passage 7 of the injection nozzle 1 at the atomization edge 5. The momentum of the combustion air flowing in at high pressure is used for atomization. The liquid fuel can therefore be introduced into the injection nozzle at a relatively low pressure. The size of the fuel droplets after atomization can be set by the gap width t and, therefore, by the thickness of the fuel film. The gap width t is usually selected to be less than half a millimeter in order to achieve optimum mixing between the fuel and the combustion air.

A fuel concentration which is as homogeneous as possible over the annular cross section to which it is admitted occurs at the burner outlet 18 of the burner 10. A defined bonnet-shaped recirculation zone 21 appears at the burner outlet and ignition takes place at its apex. The flame itself is stabilized by the recirculation zone in front of the burner without the need for a mechanical flame holder.

The invention is not, of course, limited to the embodiment example shown and described. The shape and number of the distribution pins is essentially arbitrary and only the uniform distribution of the fuel is decisive. The extent of the injection nozzles in the tangential slot and the position of the intermediate pieces must be matched to the air flow through the tangential slot.

Furthermore, the burner can also be operated with gaseous fuel. For this purpose, gas inlet openings in the form of nozzles are provided which are distributed in the longitudinal direction in the region of the tangential slots in the walls of the two partial bodies. In such gas operation, the formation of the mixture with the combustion air likewise begins in the zone of the tangential inlet slots.

Figure 5:
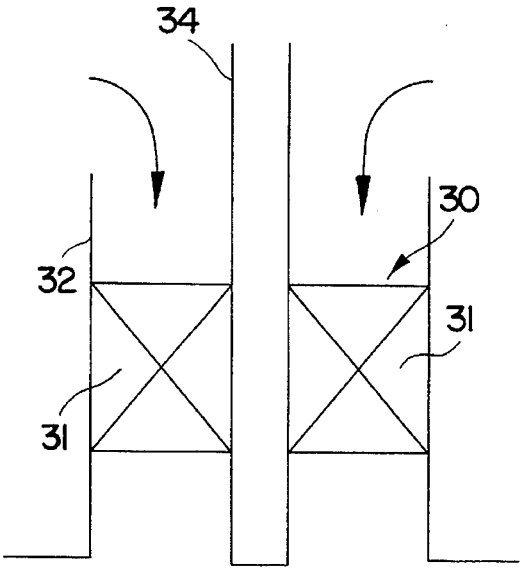
FIG. 5 shows a cross section through a swirl body.

FIG. 5 shows a conventional burner with swirl body 30, consisting essentially of a tube 32, a plurality of deflection bodies 31 with aerofoil profile and a fuel lance 34 arranged in the center.

Figure 7:
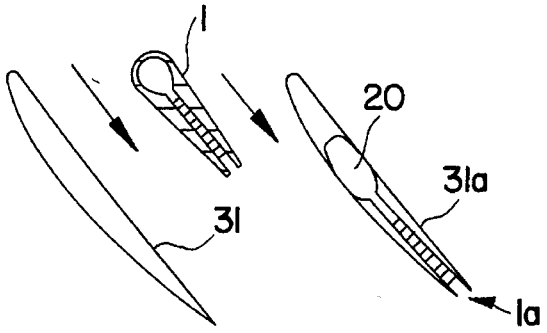
FIG. 7 shows a partial development of the swirl body.
Figure 6:
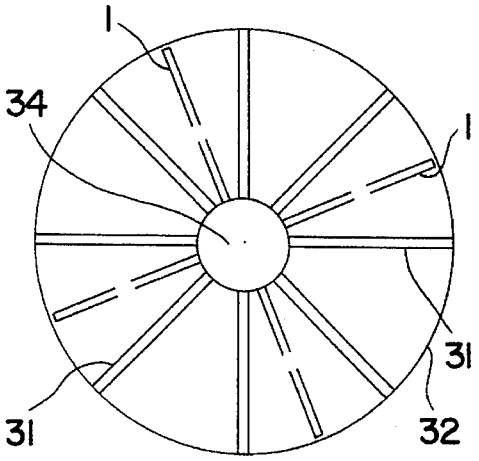
FIG. 6 shows an end view, against the flow direction, of a swirl body.

As shown in FIG. 6, the injection nozzles 1 described above can, of course, also be installed in the swirl body 30 between the deflection bodies 31. Optimum mixing between the fuel and the combustion air prior to ignition is achieved by this means. The number of injection nozzles 1 can, of course, arbitrarily deviate from FIG. 6 and can be matched to the respective given data. The supply of fuel to the injection nozzles 1 can take place directly from the fuel lance 34 by means of conduits, which are not shown. As shown in FIG. 7, it is possible to integrate the injection nozzle directly into the deflection body 31*a*. This integrated nozzle la has the same functional construction as the injection nozzle 1. Thus, for example, the fuel conduit 2*a* is simply matched to the spatial given data in the deflection body 31*a*. In this case, the fuel supply can also, of course, take place through the fuel lance 34. Here again, the shape and number of the distribution pins is, of course, essentially arbitrary.

The injection nozzles can also be employed in other arrangements. The essential feature is a sufficiently high energy level of the gaseous medium into which the liquid working medium is introduced. The injection nozzle can therefore be employed in any type of premixing burner.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An injection nozzle for introducing fuels into compressed gaseous media, for use in premixing burners (10) for example, the injection nozzle (1) consisting primarily of a fuel conduit (2) and a passage (7) branching off from the fuel conduit, the fuel conduit (2) extending lengthwise essentially at right angles to the direction of introduction of the fuel and the passage (7) extending parallel to the direction of introduction of the fuel, wherein the fuel is fed via slots (6) in the fuel conduit and by means of the passage (7) to an atomization edge (5), the inside of the passage (7) being made up of distribution panels (3) between which distribution pins (4) are arranged.

2. The injection nozzle as claimed in claim 1, wherein at least one intermediate piece (8) is arranged in the passage (7), a plurality of distribution panels (3) being formed by this means.

3. The injection nozzle as claimed in claim 1, wherein the injection nozzle (1) is of aerodynamic design on the outside.

4. The injection nozzle as claimed in claim 1, wherein the gap width (t) of the passage (7) is at most half a millimeter at the atomization edge (5).

5. The injection nozzle as claimed in claim 1, wherein the injection nozzle (1) is arranged in the tangential air inlet slots (19) of a premixing burner of the double-cone type.

6. The injection nozzle as claimed in claim 1, wherein at least one injection nozzle (1) is arranged between two adjacent deflection bodies (31) in a swirl body (30) through which compressed gaseous media flow.

7. The injection nozzle as claimed in claim 1, wherein an injection nozzle (1*a*) is arranged within at least one deflection body (31) of the swirl body (30) through which compressed gaseous media flow.

* * * * *